US006971849B2

(12) United States Patent
Saito et al.

(10) Patent No.: US 6,971,849 B2
(45) Date of Patent: Dec. 6, 2005

(54) COMPRESSOR AND ALUMINUM MEMBERS ASSEMBLED BY ARC WELDING

(75) Inventors: Takayasu Saito, Kumagaya (JP); Hiroyuki Matsumori, Gunma-Ken (JP); Dai Matsuura, Ohta (JP); Takashi Sato, Kumagaya (JP); Toshiyuki Ehara, Ohta (JP)

(73) Assignee: SANYO Electric Co., Ltd., Osaka (JP)

( * ) Notice: Subject to any disclaimer, the term of this patent is extended or adjusted under 35 U.S.C. 154(b) by 35 days.

(21) Appl. No.: 10/719,343

(22) Filed: Nov. 20, 2003

(65) Prior Publication Data

US 2004/0115072 A1 Jun. 17, 2004

(30) Foreign Application Priority Data

Dec. 13, 2002 (JP) ..... 2002-362134
Jul. 18, 2003 (JP) ..... 2003-276366

(51) Int. Cl.[7] ..... F04D 29/40

(52) U.S. Cl. ..... 415/215.1; 220/612; 419/423.14

(58) Field of Search ..... 415/215.1, 200, 415/201; 219/137 WM; 417/423.14, DIG. 1; 220/610, 611, 612, 678

(56) References Cited

U.S. PATENT DOCUMENTS 6,440,583 B1 * 8/2002 Ueno et al. ..... 428/654
6,517,328 B2 * 2/2003 Makino et al. ..... 417/410.1

OTHER PUBLICATIONS

Robert L. Norton, 1998, Prentic-Hall Inc. 2nd edition, p. 994.*

* cited by examiner

*Primary Examiner*—Edward K. Look
*Assistant Examiner*—Dwayne White
(74) *Attorney, Agent, or Firm*—J.C. Patents

(57) ABSTRACT

A compressor for receiving at least one compression element in a sealed container is provided. The sealed container comprises a container body and a cover member for blocking an opening of the container body, both of which are made of an aluminum material. The cover member is electrically welded to the container body over an entire circumference of the cover member, and thick ribs with a thickness dimension extending from a circumference portion to a central portion are formed with a predetermined pitch on the cover member. In this manner, an increase in the manufacturing cost and a reduction of the workability can be substantially suppressed, while the reliability of the sealed container of the compressor and the aluminum members assembled by arc welding can be substantially improved.

3 Claims, 1 Drawing Sheet

COMPRESSOR AND ALUMINUM MEMBERS ASSEMBLED BY ARC WELDING

CROSS-REFERENCE TO RELATED APPLICATION

This application claims the priority benefit of Japanese application serial nos. 2002-362134, filed on Dec. 13, 2002 and 2003-276366, filed on Jul. 18, 2003.

BACKGROUND OF THE INVENTION

1. Field of the Invention

This invention relates in general to a compressor and aluminum members that are assembled by arc welding.

2. Description of Related Art

Conventionally, a sealed container of a compressor formed by members (e.g., steel plates), assembled by arc welding, comprises a container body for receiving an electric motor element and compression elements, and a cover member for blocking an opening of the container body. After the electric motor element and the compression elements are assembled into the container body, the container body is then engaged with the outside of the cover member. The engaging portion is welded by applying a certain current/voltage to complete the assembly of the container body with the cover member. For example, this method is described in Japanese Laid Open Publication 2000-104689.

For example, when the aforementioned compressor is mounted into an engine room of a vehicle, the compressor weight will have an influence on the vehicle weight. As a result, this causes a problem that the mileage of the vehicle decreases.

Therefore, in order to make compressor light in weight, one may attempt to construct the sealed container by using a light material, for example, an aluminum material. As compared with steel plates, the aluminum is advantageously very light, but has a very high thermal conductivity. As heat is provided to the aluminum sealed container, the strength of the aluminum decreases rapidly. Therefore, when the aluminum parts of the container body and the cover member are welded by applying a certain current and/or voltage, which is similar to welding the steel plates conventionally, the welding status changes as the temperature of the engaging portion and its ambient portion increases. The worst result is that the sealed container will break.

Therefore, a welding method is proposed to solve this problem, in which according to the temperature variation, etc., the welding is performed by gradually varying the current and/or voltage without changing the welding condition. However, according to the aforementioned method, the welding process requires a particular welding machine and the welding status is also required to be seriously monitored, which causes substantial increase in the manufacturing cost and a reduction in the reliability of the sealed container.

SUMMARY OF THE INVENTION

According to the foregoing description, an object of this invention is to provide a compressor and the aluminum members assembled by arc welding, wherein an increase in the manufacturing cost and a reduction of the workability can be extremely suppressed, while the reliability of the sealed container of the compressor and the aluminum members assembled by arc welding can be substantially improved.

According to the above objects, the present invention provides an aluminum member assembled by arc welding. The aluminum member comprises a first aluminum member and a second aluminum member, both of which are electrically welded over a predetermined range. A thickness dimension of the first aluminum member containing welded locations is alternatively thicken with a predetermined pitch. Accordingly, because of the thick welding portion of the first aluminum member, redundant heat during the welding process can be dissipated.

According to the above configuration, the reliability of the aluminum member formed by arc welding can be improved. Furthermore, since the welding process can be performed directly under the initially set conditions without changing various conditions, such as the current and the voltage, etc. of the welding machine during the welding process, the manufacturing cost can be thus reduced.

In addition, since it is not necessary to monitor the welding status seriously, the workability can be improved. Moreover, the durability of the electrically welded aluminum members can be maintained.

The present invention further provides a compressor for receiving at least one compression element in a sealed container. The sealed container comprises a container body and a cover member for blocking an opening of the container body, both of which are made of an aluminum material, wherein the cover member is electrically welded to the container body over an entire circumference of the cover member. Further, thick ribs with a thickness dimension from a circumference portion to a central portion are formed with a predetermined pitch on the cover member. By forming the ribs, redundant heat during the welding process can be dissipated.

According to the above configuration, the reliability of the aluminum member formed by arc welding can be improved. Furthermore, since the welding process can be performed directly under the initially set conditions without changing various conditions, such as the current and the voltage, etc. of the welding machine during the welding process, the manufacturing cost can be thus reduced.

In addition, since it is not necessary to monitor the welding status seriously, the workability can be improved. Moreover, because the container body and the cover member both made of the aluminum material are welded to fix each other, a disadvantage of the strength reduction of the engaging portion and its ambient portion between the container body and the cover member can be eliminated, and therefore, the durability of the sealed container can be maintained.

Furthermore, when a compressor formed by using the aforementioned sealed container 12, the mileage can increase because of a reduction of the vehicle weight.

In addition, the present invention further provides a compressor, for receiving at least one compression element in a sealed container, and the sealed container comprises a container body and a cover member for blocking an opening of the container body, both of which are made of an aluminum material. The cover member is electrically welded to the container body over an entire circumference of the cover member, and the aluminum material has a Young modulus equal to or larger than 6000 and a silicon content of 0.1% to 12%. Accordingly, the welding property can be well maintained, and the strength of the sealed container for the compressor can be sufficiently maintained.

According to the above configuration, the welding property during the welding process can be well maintained, and a sufficient strength can be provided for a compressor of an internal high pressure type. The durability of the sealed container can be also maintained.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

The objects, mentioned above for extremely suppressing the increasing of the manufacturing cost and a reduction of workability as well as for achieving an improvement of reliability of the sealed container of the compressor and aluminum members assembled by arc welding, can be implemented in a manner that the thickness dimension of the aforementioned first aluminum member having the welding portions is increased with a prescribed pitch and arranged alternately.

Figure 1:
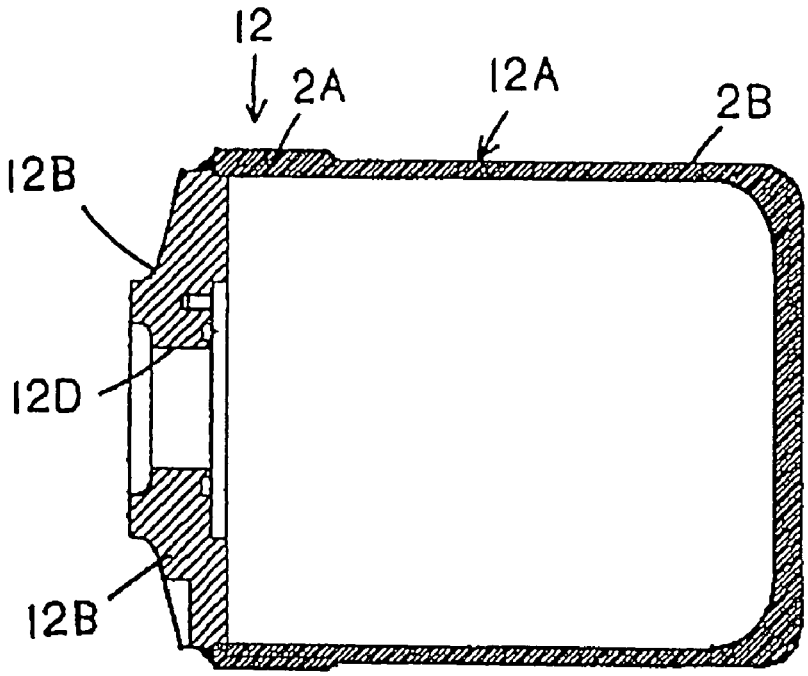
FIG. 1 is a vertically cross-sectional view of a sealed container of a compressor according to one embodiment of the present invention.
Figure 2:
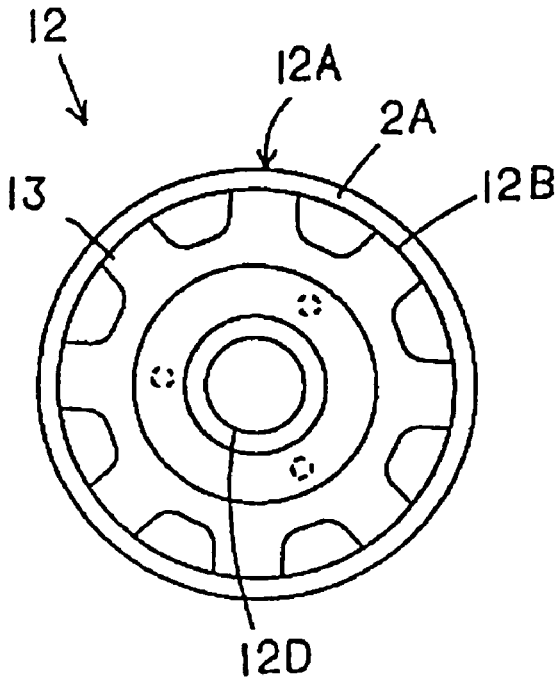
FIG. 2 is a plane view of the sealed container in FIG. 1.

The embodiment of the present invention is described in detail accompanying with attached drawings. FIG. 1 shows a vertically cross-sectional view of a sealed container 12 of a compressor constructed from aluminum, which is comprised of, for example, aluminum members assembled by arc welding. FIG. 2 is a plane view of the sealed container shown in FIG. 1. In FIG. 1, electric motor member and compression elements received within the sealed container are not depicted.

Although not shown in the drawings, the disclosure of the present invention can be applied to, for example, a two-stage compression and internal intermediate pressure type compressor, a two-stage compression and internal high-pressure type compressor, and a single-stage compression and internal high-pressure type compressor, etc. The refrigerant used in a freezing cycle having the above compressor can use $CO_2$ refrigerant, HC refrigerant, and HFC refrigerant, etc. In addition, as an oil used together with such refrigerant can be PAG (poly alkyl glycol), PVE (poly vinyl ether), POE (polyol ester), or mineral oil, etc.

In particular, when $CO_2$ is used as the refrigerant, designed pressures are 16 MPaG at a high-pressure side (high pressure) and 11 MPaG at a low-pressure side (intermediate pressure) in a two-stage compression and internal intermediate pressure type compressor, in which the pressures are very high as compared with the HFC or the HC refrigerant. Even though in such a high pressure condition, the sealed container 12 of the present invention can still maintain sufficient strength.

The sealed container 12 comprises a container body (the second aluminum member) 12A and an end cap (the first aluminum member) 12B with a substantial bowl shape that is used as a cover member for blocking an upper opening of the container body 12A. In addition, an electric motor element and compression elements (not shown) are received within the container body 12A. In addition, a circular installation hole 12D is formed at a central portion of the end cap 12B, and a terminal (not shown) for providing power to the electric motor element is installed to the installation hole 12D.

Referring to FIG. 1, the container body 12A comprises an engaging portion 2A and a body portion 2B. The engaging portion 2A is formed with a thickness thicker than that of the body portion 2B, and the first and the second aluminum members have a Young modulus equal to or larger than 6000 and has silicon (Si) content of 0.1%–12%. Considering welding conditions of equipments or apparatus, particularly, by making the aluminum members having a Si content of 1.0%±0.2% in the embodiment, the welding property van be well maintained and the strength can also be sufficient even in a case of welding the container body 12A and the end cap 12B. Furthermore, by using a thicker engaging portion 2A, the strength of the engaging portion and its ambient portion can be substantially increased or the strength thereof can be substantially prevented from being reduced.

In addition, a larger Si content can increase the strength, while a smaller Si content can provide an improvement of the welding property. Therefore, the Si content is thus determined within a proper range of 0.1% to 12%, with consideration of the refrigerant and the apparatus used. Moreover, the Si content in the aluminum members can improve a lubrication property thereof.

Thick ribs 13, each with a thickness, extending from the circumference to the central portion, are formed on the aforementioned end cap 12B. In other words, when welding the container 12A and the end cap 12B, locations where the ribs 13 are made and locations where the ribs 13 are not made, are alternatively formed on locations to serve as the engaging portions that are engaged with the inner side of the engaging portion 2A of the container body 12A.

The ribs 13 is formed for avoiding adverse issues, such as, when the temperature of the engaging portion and its ambient portion increases too much, the engaging portion 2A of the container body 12A and the engaging portions of the end cap 12B will be melted by an amount above the requirement which tends to reduce the strength of the engaging portions and the ambient portion, and in a worst case, the container body may get perforated. According to an embodiment of the present invention, by using the ribs 13 formed on the thicken portion, heat generated during the welding process can be dissipated. The locations where the ribs 13 are formed and the locations where ribs 13 are not formed are alternatively arranged with a pitch in a manner that when the welding process is performed under a predetermined condition, the welding status (the melted status of the container body 12A and the end cap 12B) is substantially the same without varying the voltage and/or current.

Conventionally, when welding the container body 12A and the end cap 12B constructed by aluminum, the engaging portions are required to be confirmed and monitored, when gradually varying the voltage and the current of the welding machine. However, by forming the thick ribs 13, having the thickness dimension, extending from the circumference portion of the end cap 12B to the central portion, with the prescribed pitch, heat that increases above the required amount during the welding process can be dissipated. Therefore, the welding process can be performed under the certain condition without changing the voltage and the current.

Next, in a case of welding the container body 12A and the end cap 12B, after the electric motor element and the compression elements (not shown) are installed into the container body 12A, the lower end of the end cap 12B is inserted to engage with the inner side of the upper end of the opening of the container body 12A. At this time, the terminal (not shown) is first inserted into the installation hole 12D from the lower side of the end cap 12B to fix onto the end cap 12B by bolts, etc. Then, under that status, the engaging portion 2A, which is the upper end of the container body 12A at the engaging portion, and the circumference portion where the ribs 13 of the end cap 12B (as the inner side at the engaging portion) are formed thereon are electrically welded over the entire circumference.

The arc welding starts from the locations where the ribs 13 are not formed. Namely, by starting the arc welding from the locations where the ribs 13 are not formed, the aluminum members are sufficiently heated, and the engaging portion 2A and the end cap 12B are suitably melted to integrate as a whole, so that the engaging portion 2A and the end cap 12B can be connected and fixed.

On the other hand, since the container body 12 and the end cap 12B is formed by the aluminum members as described above, the engaging portion 2A and the end cap 12B will be melted by an amount above the requirement as being welded under certain the same conditions. In this way, the strength of the engaging portions and the ambient portion will reduce, and in a worse case, the container body gets perforated. However, as described above, since the ribs 13 are arranged with a predetermined pitch, heat is radiated at the welding locations and their ambient portion of the ribs 13, and therefore, the temperature decreases. In this manner, the engaging portion 2A and the end cap 12B can be effectively prevented from being melted by an amount above the requirement.

When the temperature decreases, the welding process continues to reach the locations where the ribs 13 are not formed, and therefore, the welding temperature rises again. Therefore, this can avoid the conventional defect that the welding temperature decreases too much so that the container body 12A and the end cap 12B are not sufficiently welded. As described above, by sequentially welding the locations where the ribs 13 are formed and not formed, the arc welding can be performed while the welding temperature can be maintained. In addition, the entire circumference over the container body 12A and the end cap 12B can be welded under almost the same welding status.

In this way, the arc welding can be performed directly under the initially set voltage and current without controlling the voltage and the current during the arc welding as in the case of the conventional welding. As a result, the welding process can be easily performed without managing and varying the rigorous setting conditions during the welding process.

In addition, the reliability of the sealed container 12, which is constructed by the aluminum members that are formed by arc welding, can be improved. Furthermore, since the welding process is performed directly under the initially set conditions without changing various conditions of the voltage and the current, etc. of the welding machine during the welding process, the manufacturing cost can be thus reduced.

Furthermore, since it is not necessary to monitor the welding status seriously, the workability can be improved. In addition, disadvantages, such as the strength reduction at the engaging portions and their ambient portions of the container body 12A and the end cap 12B, can be eliminated. The durability of the sealed container 12 can be also maintained.

Furthermore, by using the aluminum members with a Young modulus over 6000 and a Si content of 0.1% to 12% to construct the sealed container 12 of the compressor, and because the lubrication property thereof is substantially improved due to the Si content, the oil separated in the sealed container 12 can slide down smoothly along the inner wall of the sealed container 12, and then is guided into an oil accumulator. Therefore, in an internal intermediate pressure or an internal high pressure compressor, the oil that is adhered in the vicinity of the refrigerant discharging outlet flows down the oil accumulator without staying. Therefore, the oil discharging amount from the sealed container 12 can be extremely reduced because the discharged oil together with the refrigerant can be reduced.

When a compressor formed by using the aforementioned sealed container 12, the mileage can increase because of a reduction of the vehicle weight. In this manner, the generality of the members constructed by aluminum material can be improved.

In the embodiment of the invention, the aluminum container body 12A and the aluminum end cap 12B are electrically welded to form the sealed container 12 of the compressor. However, the invention is suitable for any structure that is formed using aluminum members by arc welding.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. An aluminum member, assembled by arc welding, comprising a first aluminum member, a second aluminum member both of which are electrically welded together to engage a portion of the first aluminum member and a portion of the second aluminum member, and a plurality of ribs formed on the first aluminum member, wherein the ribs are arranged along the engaged portion of the first aluminum member with a predetermined pitch.

2. A compressor, for receiving at least one compression element in a sealed container, the sealed container comprising a container body and a cover member for blocking an opening of the container body, both of which are made of an aluminum material, wherein the cover member is electrically welded to the container body over an entire circumference of the cover member, and wherein thick ribs with a thickness dimension extending from a circumference portion to a central portion are formed with a predetermined pitch on the cover member.

3. A compressor, for receiving at least one compression element in a sealed container, the sealed container comprising a container body, a cover member for blocking an opening of the container body, both of which are made of an aluminum material, and a plurality of ribs formed on the cover member, wherein the cover member is electrically welded to the container body over an entire circumference of the cover member, and wherein the ribs are arranged in the entire circumference of the cover member with a predetermined pitch, and the aluminum material has and a silicon content of 0.1% to 12%.

* * * * *